US010738772B2

(12) United States Patent
Bullard et al.

(10) Patent No.: US 10,738,772 B2
(45) **Date of Patent: *Aug. 11, 2020**

(54) PUSH-PULL COMPRESSOR HAVING ULTRA-HIGH EFFICIENCY FOR CRYOCOOLERS OR OTHER SYSTEMS

(71) Applicant: Raytheon Company, Waltham, MA (US)

(72) Inventors: Andrew L. Bullard, Manhattan Beach, CA (US); Theodore J. Conrad, Redondo Beach, CA (US)

(73) Assignee: Raytheon Company, Waltham, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/541,816

(22) Filed: Aug. 15, 2019

(65) Prior Publication Data

US 2019/0368480 A1 Dec. 5, 2019

Related U.S. Application Data

(63) Continuation of application No. 15/676,808, filed on Aug. 14, 2017, now Pat. No. 10,422,329.

(51) Int. Cl.
*F04B 35/04* (2006.01)
*F04B 17/03* (2006.01)
(Continued)

(52) U.S. Cl.
CPC ..... *F04B 35/04* (2013.01); *F04B 17/03* (2013.01); *F04B 35/045* (2013.01);
(Continued)

(58) Field of Classification Search
CPC ..... F04B 3/00; F04B 35/04; F04B 35/045; F04B 17/03; F04B 39/0005; F25B 9/06; F25B 9/14; F25B 31/023
(Continued)

(56) References Cited

U.S. PATENT DOCUMENTS 3,515,034 A 6/1970 Eklund
3,657,877 A 4/1972 Huffman
(Continued)

FOREIGN PATENT DOCUMENTS

EP 1450042 A1 8/2004
EP 1538406 A2 6/2005
(Continued)

OTHER PUBLICATIONS

International Search Report and Written Opinion of the International Searching Authority for International Patent Application No. PCT/US2018/026691 dated Jul. 9, 2018, 12 pages.
(Continued)

*Primary Examiner* — Joel M Attey

(57) ABSTRACT

An apparatus includes a first piston and an opposing second piston, where the first and second pistons are configured to move inward to narrow a space therebetween and to move outward to enlarge the space therebetween. The apparatus also includes a first voice coil actuator having (i) a first voice coil connected to the first piston and (ii) a first magnet connected to the second piston. The apparatus may further include a second voice coil actuator having (i) a second voice coil connected to the second piston and (ii) a second magnet connected to the first piston. Each voice coil actuator may be configured to apply equal and opposite forces on or against the first and second pistons.

20 Claims, 6 Drawing Sheets

(51) Int. Cl.

| | |
|---|---|
| ***F04B 39/00*** | (2006.01) |
| ***F25B 31/02*** | (2006.01) |
| ***F25B 9/06*** | (2006.01) |
| ***F25B 9/14*** | (2006.01) |
| *F04B 3/00* | (2006.01) |

(52) U.S. Cl.
CPC ..... *F04B 39/0005* (2013.01); *F25B 9/06* (2013.01); *F25B 9/14* (2013.01); *F25B 31/023* (2013.01); *F04B 3/00* (2013.01)

(58) Field of Classification Search
USPC ..... 417/417, 418; 62/6
See application file for complete search history.

(56) References Cited

U.S. PATENT DOCUMENTS

| | | | | |
|---|---|---|---|---|
| 3,802,211 | A | 4/1974 | Bamberg et al. | |
| 3,986,360 | A | 10/1976 | Hagen et al. | |
| 4,145,725 | A | 3/1979 | Wallis | |
| 4,450,685 | A | 5/1984 | Corey | |
| 4,511,805 | A | 4/1985 | Boy-Marcotte et al. | |
| 4,697,113 | A | 9/1987 | Young | |
| 4,797,749 | A | 1/1989 | Paulsen | |
| 5,018,357 | A | 5/1991 | Livingstone et al. | |
| 5,022,229 | A | 6/1991 | Vitale | |
| 5,023,531 | A | 6/1991 | Altemose et al. | |
| 5,088,289 | A | 2/1992 | Mita et al. | |
| 5,317,874 | A | 6/1994 | Penswick et al. | |
| 5,342,176 | A | 8/1994 | Redlich | |
| 5,492,313 | A | 2/1996 | Pan et al. | |
| 5,783,915 | A | 7/1998 | Shida et al. | |
| 5,826,491 | A | 10/1998 | Steiger | |
| 5,836,165 | A | 11/1998 | Champion et al. | |
| 5,978,600 | A | 11/1999 | Takeuchi et al. | |
| 6,092,999 | A | 7/2000 | Lilie et al. | |
| 6,098,409 | A | 8/2000 | Chase | |
| 6,129,527 | A | 10/2000 | Donahoe et al. | |
| 6,256,999 | B1 | 7/2001 | Chase | |
| 6,289,680 | B1 | 9/2001 | Oh et al. | |
| 6,327,862 | B1 | 12/2001 | Hanes | |
| 6,446,444 | B1 | 9/2002 | Chase et al. | |
| 6,611,118 | B2 | 8/2003 | Abe et al. | |
| 6,688,113 | B1 | 2/2004 | Kunimoto et al. | |
| 6,762,745 | B1 | 7/2004 | Braun et al. | |
| 6,782,700 | B1 | 8/2004 | Unger et al. | |
| 6,809,486 | B2 | 10/2004 | Qiu et al. | |
| 6,843,057 | B2 | 1/2005 | Yamamoto | |
| 6,933,629 | B2 | 8/2005 | Qiu et al. | |
| 7,062,922 | B1 | 6/2006 | Kirkconnell et al. | |
| 7,113,351 | B2 | 9/2006 | Hovanky | |
| 7,184,254 | B2 | 2/2007 | Dimanstein | |
| 7,891,184 | B2 | 2/2011 | Gimsa | |
| 8,201,467 | B2 | 6/2012 | Johnson et al. | |
| 8,231,355 | B2 | 7/2012 | Tian et al. | |
| 8,490,414 | B2 | 7/2013 | Hon et al. | |
| 8,981,682 | B2 | 3/2015 | Delson et al. | |
| 9,145,878 | B1 * | 9/2015 | McKenzie | F04B 35/045 |
| 9,285,073 | B2 | 3/2016 | Ellis et al. | |
| 9,551,513 | B2 | 1/2017 | Yates et al. | |
| 9,577,562 | B2 | 2/2017 | Conrad et al. | |
| 10,234,075 | B2 | 3/2019 | Conrad et al. | |
| 10,298,164 | B2 | 5/2019 | Savage, II et al. | |
| 10,323,628 | B2 * | 6/2019 | Stair | F04B 17/042 |
| 2003/0218854 | A1 | 11/2003 | Dimanstein | |
| 2003/0234629 | A1 | 12/2003 | Trifilo | |
| 2004/0000149 | A1 | 1/2004 | Kirkconnell et al. | |
| 2004/0027088 | A1 | 2/2004 | Abe et al. | |
| 2004/0168445 | A1 | 9/2004 | Kunitani et al. | |
| 2004/0174614 | A1 | 9/2004 | Hovanky | |
| 2004/0232868 | A1 | 11/2004 | Sawtell et al. | |
| 2004/0234394 | A1 | 11/2004 | Duncan et al. | |
| 2004/0263005 | A1 | 12/2004 | McGill et al. | |
| 2005/0082994 | A1 | 4/2005 | Qiu et al. | |
| 2005/0168179 | A1 | 8/2005 | McGill et al. | |
| 2005/0210886 | A1 | 9/2005 | Lynch | |
| 2006/0070518 | A1 | 4/2006 | McGill et al. | |
| 2006/0104451 | A1 | 5/2006 | Browning et al. | |
| 2006/0187572 | A1 | 8/2006 | Tan et al. | |
| 2006/0290662 | A1 | 12/2006 | Houston et al. | |
| 2007/0029956 | A1 | 2/2007 | Hofer | |
| 2007/0095073 | A1 | 5/2007 | Tian et al. | |
| 2007/0152512 | A1 | 7/2007 | Tian et al. | |
| 2007/0164694 | A1 | 7/2007 | Boscolo Berto | |
| 2008/0218823 | A1 | 9/2008 | Mizoguchi | |
| 2009/0015186 | A1 | 1/2009 | Boling et al. | |
| 2010/0072842 | A1 | 3/2010 | Johnson et al. | |
| 2010/0125167 | A1 | 5/2010 | Sugimoto | |
| 2011/0248817 | A1 | 10/2011 | Houston et al. | |
| 2012/0098469 | A1 | 4/2012 | Takeuchi | |
| 2012/0232780 | A1 | 9/2012 | Delson et al. | |
| 2013/0016413 | A1 | 1/2013 | Saeedi et al. | |
| 2013/0088176 | A1 | 4/2013 | Kwon et al. | |
| 2013/0154539 | A1 | 6/2013 | Grossmann et al. | |
| 2013/0169857 | A1 | 7/2013 | Christo et al. | |
| 2014/0069115 | A1 | 3/2014 | Bellis et al. | |
| 2015/0125323 | A1 | 5/2015 | Stair et al. | |

FOREIGN PATENT DOCUMENTS

| | | | |
|---|---|---|---|
| JP | S49-83043 | A | 8/1974 |
| JP | S63-238368 | A | 10/1988 |
| JP | 2004068662 | A | 3/2004 |
| SU | 1651054 | A1 | 5/1991 |
| WO | 2011022769 | A1 | 3/2011 |
| WO | 2013126719 | A2 | 8/2013 |

OTHER PUBLICATIONS

International Search Report and Written Opinion of the International Searching Authority for International Patent Application No. PCT/US2015/020756 dated Aug. 13, 2015, 9 pages.

International Search Report and Written Opinion of the International Searching Authority for International Patent Application No. PCT/US2015/054039 dated Jan. 20, 2016, 13 pages.

International Search Report and Written Opinion of the International Searching Authority for International Patent Application No. PCT/US2015/025928 dated Jul. 28, 2015, 5 pages.

International Search Report for International Patent Application No. PCT/US2015/025928 dated Jul. 28, 2015, 4 pages.

International Search Report and Written Opinion of the International Searching Authority for International Patent Application No. PCT/US2008/006210 dated Oct. 23, 2008, 7 pages.

Wikipedia, "Counter-electromotive force", printed Dec. 2014, last modified Jun. 2014, 2 pages.

Database WPI Week 198835, Thomson Scientific, London, GB, AN 1988-248229, XP002499651 & SU 1 374 002 A, OMSK POLY, Feb. 1988, 1 page.

Meijers et al., "Flexure Bearing Cryocoolers at Thales Cryogenics", Cryogenic Engineering Conference, Jul. 2001, 8 pages.

Mullie et al., "Development of the LSF 95xx 2nd Generation Flexure Bearing Coolers", SPIE, Mar.-Apr. 2005, 7 pages.

* cited by examiner

PUSH-PULL COMPRESSOR HAVING ULTRA-HIGH EFFICIENCY FOR CRYOCOOLERS OR OTHER SYSTEMS

CROSS-REFERENCE TO RELATED APPLICATION AND PRIORITY CLAIM

This application claims priority under 35 U.S.C. § 120 as a continuation of U.S. patent application Ser. No. 15/676,808 filed on Aug. 14, 2017. This application is hereby incorporated by reference in its entirety.

TECHNICAL FIELD

This disclosure is generally directed to compression and cooling systems. More specifically, this disclosure is directed to a push-pull compressor having ultra-high efficiency for cryocoolers or other systems.

BACKGROUND

Cryocoolers are often used to cool various components to extremely low temperatures. For example, cryocoolers can be used to cool focal plane arrays in different space and airborne imaging systems. There are various types of cryocoolers having differing designs, such as pulse tube cryocoolers and Stirling cryocoolers.

Unfortunately, many cryocooler designs are inefficient and require large amounts of power during operation. For instance, cryocoolers commonly used to cool components in infrared sensors may require 20 watts of input power for each watt of heat lift at a temperature of 100 Kelvin. This is due in part to the inefficiency of compressor motors used in the cryocoolers. Compressor motors often convert only a small part of their input electrical energy into mechanical work, leading to poor overall cryocooler efficiency. While compressor motors could achieve higher efficiencies if operated over larger strokes, the achievable stroke in a cryocooler can be limited by flexure or spring suspensions used with the compressor motors.

Cryocooler compressors also often use two opposing pistons to provide compression, but these types of cryocoolers can have mismatches in the forces exerted by the opposing pistons. This leads to the generation of net exported forces. These exported forces could be due to various causes, such as mismatches in moving masses, misalignment, mismatched flexure or spring resonances, and mismatched motor efficiencies. The exported forces often need to be suppressed to prevent the forces from detrimentally affecting other components of the cryocoolers or other systems. However, such suppression typically requires additional components, which increases the complexity, weight, and cost of the systems.

SUMMARY

This disclosure provides a push-pull compressor having ultra-high efficiency for cryocoolers or other systems.

In a first embodiment, an apparatus includes a first piston and an opposing second piston, where the first and second pistons are configured to move inward to narrow a space therebetween and to move outward to enlarge the space therebetween. The apparatus also includes a first voice coil actuator having (i) a first voice coil connected to the first piston and (ii) a first magnet connected to the second piston.

In a second embodiment, a system includes a compressor configured to compress a fluid. The compressor includes a first piston and an opposing second piston, where the first and second pistons are configured to move inward to narrow a space therebetween and to move outward to enlarge the space therebetween. The compressor also includes a first voice coil actuator having (i) a first voice coil connected to the first piston and (ii) a first magnet connected to the second piston.

In a third embodiment, a method includes coupling a first voice coil of a first voice coil actuator to a first piston and coupling a first magnet of the first voice coil actuator to a second piston. The first voice coil actuator is configured to cause the first and second pistons to move inward to narrow a space therebetween and to move outward to enlarge the space therebetween.

Other technical features may be readily apparent to one skilled in the art from the following figures, descriptions, and claims.

BRIEF DESCRIPTION OF THE DRAWINGS

For a more complete understanding of this disclosure, reference is now made to the following description, taken in conjunction with the accompanying drawings, in which.

DETAILED DESCRIPTION

Figure 1:
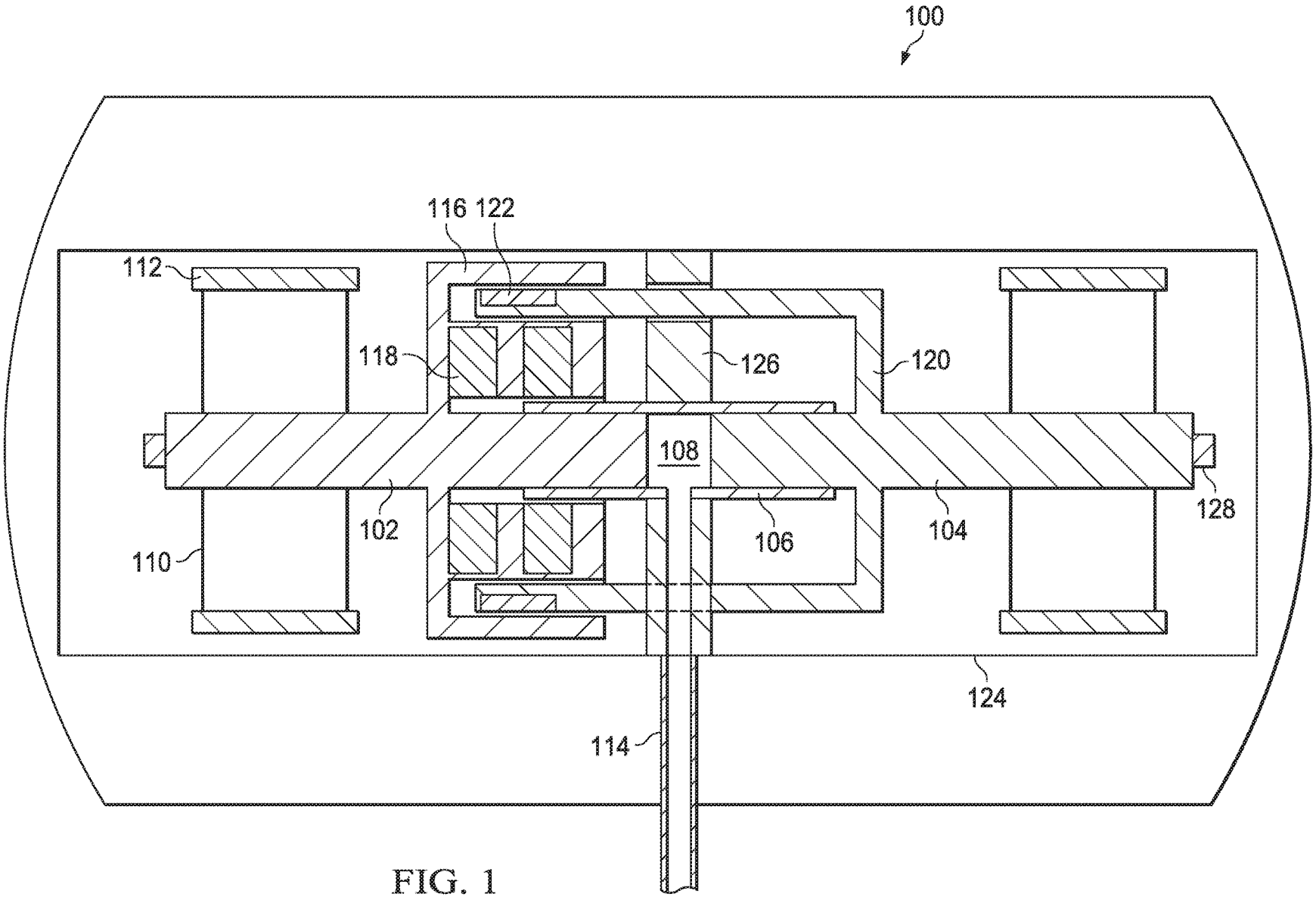
FIG. 1 illustrates a first example push-pull compressor having ultra-high efficiency for cryocoolers or other systems according to this disclosure.

FIGS. 1 through 6, described below, and the various embodiments used to describe the principles of the present invention in this patent document are by way of illustration only and should not be construed in any way to limit the scope of the invention. Those skilled in the art will understand that the principles of the present invention may be implemented in any type of suitably arranged device or system.

As noted above, many cryocooler designs are inefficient and require large amounts of power during operation, which is often due to the inefficiency of their compressor motors. Compressor motors are typically implemented using a voice coil-type of linear motor in which a voice coil is energized to create a varying electromagnetic field that interacts with a magnet. Various cryocoolers have been designed with different configurations of linear bearings (often flexure bearings) and linear voice coil actuators to improve compressor efficiencies, but these approaches generally have one thing in common—they have actuators that are configured to push or pull a piston relative to a fixed structure. The compressor is configured so that a magnet moves with a piston and a voice coil is fixed to a base, or vice versa.

If reducing or minimizing exported forces is important, manufacturers also often employ a load cell or accelerometer feedback, coupled with independent amplifiers driving two motors that move opposing pistons. The amplifiers drive the motors, and the feedback is used to individually control the amplifiers to reduce the exported forces from a compressor. However, this can add significant complexity, weight, and cost. In general, it is often accepted that compressor motors will not be perfectly matched, so active techniques are employed to compensate for mismatches in motor efficiencies and other mechanical tolerances. In most cases, these efforts still cannot drive the exported forces resulting from piston movements down to zero, so there is a practical limit to how low the exported forces can be reduced.

In accordance with this disclosure, compressor inefficiencies and exported forces can be reduced by configuring a compressor so that a voice coil actuator (having a magnet and a coil) pushes or pulls compressor pistons against each other, rather than pushing or pulling a piston against a fixed base. In these approaches, the magnet of the voice coil actuator moves with one piston, and the voice coil of the voice coil actuator moves with the other piston. It is also possible to use multiple voice coil actuators, where the magnets of different actuators move with different pistons and the voice coils of different actuators move with different pistons. Since each actuator is pushing or pulling both pistons, the associated masses, strokes, and suspension resonances are matched, and the efficiency of the compressor is increased. Also, the magnet-to-coil stroke is double the piston stroke. Further, the flexure or spring suspension stroke stays the same as the piston stroke, which can be useful since the flexure or spring suspensions are often designed to their fatigue limits in cryocoolers.

These approaches can achieve dramatic improvements in compressor efficiencies because more mechanical work (possibly up to double the mechanical work) is being performed by each actuator applying force to two pistons rather than one. In some embodiments, this could reduce input power requirements for a compressor by up to 30%, 40%, or even more. Because each actuator includes a voice coil coupled to one piston and a magnet coupled to the other piston, this helps to passively reduce or eliminate exported forces. Passive reduction or elimination of exported forces may mean that load cells, preamplifiers, vibration control hardware and software, and a second voice coil's amplifier can be eliminated. This can significantly reduce the complexity, weight, and cost of the compressor and the overall system.

Voice coil force may be proportional to input current (Newtons/Amp) for a given actuator design, but as the actuator moves faster there is a back electro-motive force (EMF) generated proportional to velocity that cuts the force exerted by the actuator. However, the actuators in a compressor can move over a relatively small stroke and not reach a velocity at which their efficiency drops significantly due to back EMF. In fact, due to the reciprocating motion of the pistons in a compressor, the velocity goes to zero at two points in every cycle, and this concept to a first-order almost doubles the efficiency of the compressor.

There may also be a second-order drop off in efficiency over the pistons' stroke caused when a voice coil moves out of a concentrated electromagnetic field, so actuators may need to be nominally designed for double the stroke and would hence suffer some nominal drop in efficiency. Because an actuator magnet usually weighs much more than an actuator voice coil, some embodiments could be designed with two voice coil actuators, where each of two pistons includes a magnet and a voice coil from different actuators. This approach maintains symmetry and can help to keep the supported masses attached to the pistons the same, which can aid in balancing the dynamic behavior of the compressor. Both actuators could be driven by a single amplifier, and passive exported force reduction or cancellation can still be achieved. Moreover, when multiple actuators are used, there is little or no need for the two actuators' efficiencies to be matched to eliminate exported forces.

Depending on the implementation, a single actuator could be used to push or pull pistons on opposite ends, and one or more transfer lines could be used to couple both compressors to a single expander or other device. Also, multiple actuators could be operated using the same amplifier, and a "trim coil" could be employed on one piston if ultra-low exported forces is required.

FIG. 1 illustrates a first example push-pull compressor 100 having ultra-high efficiency for cryocoolers or other systems according to this disclosure. A cryocooler generally represents a device that can cool other components to cryogenic temperatures or other extremely low temperatures, such as to about 4 Kelvin, about 10 Kelvin, or about 20 Kelvin. A cryocooler typically operates by creating a flow of fluid (such as liquid or gas) back and forth within the cryocooler. Controlled expansion and contraction of the fluid creates a desired cooling of one or more components.

As shown in FIG. 1, the compressor 100 includes multiple pistons 102 and 104, each of which moves back and forth. At least part of each piston 102 and 104 resides within a cylinder 106, and the cylinder 106 includes a space 108 configured to receive a fluid. Each of the pistons 102 and 104 moves or "strokes" back and forth during multiple compression cycles, and the pistons 102 and 104 can move in opposite directions during the compression cycles so that the space 108 repeatedly gets larger and smaller.

Each piston 102 and 104 includes any suitable structure configured to move back and forth to facilitate compression of a fluid. Each of the pistons 102 and 104 could have any suitable size, shape, and dimensions. Each of the pistons 102 and 104 could also be formed from any suitable materials) and in any suitable manner. The cylinder 106 includes any suitable structure configured to receive a fluid and to receive at least portions of multiple pistons. The cylinder 106 could have any suitable size, shape, and dimensions. The cylinder 106 could also be formed from any suitable material(s) and in any suitable manner. Note that the pistons 102 and 104 and cylinder 106 may or may not have circular cross-sections. While not shown, a seal could be used between each piston 102 and 104 and the cylinder 106 to prevent fluid from leaking past the pistons 102 and 104.

Various spring or flexure bearings 110 are used in the compressor 100 to support the pistons 102 and 104 and allow linear movement of the pistons 102 and 104. A flexure bearing 110 typically represents a flat spring that is formed by a flat metal sheet having multiple sets of symmetrical arms coupling inner and outer hubs. The twisting of one arm in a set is substantially counteracted by the twisting of the symmetrical arm in that set. As a result, the flexure bearing 110 allows for linear movement while substantially reducing rotational movement. Each spring or flexure bearing 110 includes any suitable structure configured to allow linear movement of a piston. Each spring or flexure bearing 110 could also be formed from any suitable material(s) and in any suitable manner. Specific examples of flexure bearings are described in U.S. Pat. No. 9,285,073 and U.S. patent application Ser. No. 15/426,451 (both of which are hereby incorporated by reference in their entirety). The spring or flexure bearings 110 are shown here as being couple to one or more support structures 112, which denote any suitable structures on or to which the spring or flexure bearings could be mounted or otherwise attached.

The operation of the pistons 102 and 104 causes repeated pressure changes to the fluid within the space 108. In a cryocooler, at least one transfer line 114 can transport the fluid to an expansion assembly, where the fluid is allowed to expand. As noted above, controlled expansion and contraction of the fluid is used to create desired cooling in the cryocooler. Each transfer line 114 includes any suitable structure allowing passage of a fluid. Each transfer line 114 could also be formed from any suitable material(s) and in any suitable manner.

At least one projection 116 extends from the piston 102, and one or more magnets 118 are embedded within, mounted on, or otherwise coupled to the projection(s) 116. In some embodiments, a single projection 116 could encircle the piston 102, and each magnet 118 may or may not encircle the piston 102. These embodiments can be envisioned by taking the piston 102 and the projection 116 in FIG. 1 and rotating them by 180° around the central axis of the piston 102. Note, however, that other embodiments could also be used, such as when multiple projections 116 are arranged around the piston 102. Each projection 116 could have any suitable size, shape, and dimensions. Each projection 116 could also be formed from any suitable material(s) and in any suitable manner. Each magnet 118 represents any suitable magnetic material having any suitable size, shape, and dimensions.

At least one projection 120 extends from the piston 104, and one or more voice coils 122 are embedded within, mounted on, or otherwise coupled to the projection(s) 120. Again, in some embodiments, a single projection 120 could encircle the piston 104, and each voice coil 122 may or may not encircle the piston 104. These embodiments can be envisioned by taking the piston 104 and the projection 120 in FIG. 1 and rotating them by 180° around the central axis of the piston 104. Note, however, that other embodiments could also be used, such as when multiple projections 120 are arranged around the piston 104. Each projection 120 could have any suitable size, shape, and dimensions. Each projection 120 could also be formed from any suitable material(s) and in any suitable manner. Each voice coil 122 represents any suitable conductive structure configured to create an electromagnetic field when energized, such as conductive wire wound on a bobbin.

The compressor 100 in FIG. 1 is positioned within a housing 124. The housing 124 represents a support structure to or in which the compressor 100 is mounted. The housing 124 includes any suitable structure for encasing or otherwise protecting a cryocooler (or portion thereof). The housing 124 could also be formed from any suitable material(s) and in any suitable manner. In this example, one or more mounts 126 are used to couple the cylinder 106 to the housing 124, and the mounts 126 include openings that allow passage of one or more of the projections from the pistons 102 and 104. Note, however, that other mechanisms could be used to secure the compressor 100.

The magnet(s) 118 and the voice coil(s) 122 in FIG. 1 form a voice coil actuator that is used to move the pistons 102 and 104. More specifically, the voice coil 122 is used to create a varying electromagnetic field, which interacts with the magnet 118 and either attracts or repels the magnet 118. By energizing the voice coil 122 appropriately, the electromagnetic field created by the voice coil 122 repeatedly attracts and repels the magnet 118. This causes the pistons 102 and 104 to repeatedly move towards each other and move away from each other during multiple compression cycles.

In this arrangement, the voice coil actuator pushes and pulls the pistons 102 and 104 against each other, instead of having multiple voice coil actuators separately push and pull the pistons against a fixed structure. Because of this, the voice coil actuator is applying essentially equal and opposite forces against the pistons 102 and 104. As noted above, this can significantly increase the efficiency of the compressor 100 and help to passively reduce or eliminate exported forces from the compressor 100. Note that the pistons 102 and 104 can be pulled towards each other so that their adjacent ends are very close to each other (narrowing the space 108 to the maximum degree). The pistons 102 and 104 can also be pushed away from each other so that their adjacent ends are far away from each other (expanding the space 108 to the maximum degree). Repeatedly changing the pistons 102 and 104 between these positions provides compression during multiple compression cycles. To help prolong use of the compressor 100 and prevent damage to the compressor 100, the pistons 102 and 104 may not touch each other during operation.

In the example shown in FIG. 1, a resonance of the moving mass on one side of the compressor 100 may or may not be precisely matched to a resonance of the moving mass on the other side of the compressor 100. If the resonances are not precisely matched, this could lead to the creation of exported forces. To help reduce or eliminate the exported forces created in this manner, one or more of the pistons 102 and 104 could include or be coupled to one or more trim weights 128. Each trim weight 128 adds mass to the piston 102 or 104, thereby changing the resonance of the moving mass on that side of the compressor 100. For example, a trim weight 128 could be added to the side of the compressor 100 that resonates at a higher frequency compared to the other side of the compressor 100. This helps with tuning and optimizing of the passive load cancellation. Each trim weight 128 includes any suitable structure for adding mass to one side of a compressor. A trim weight 128 could be used on a single side of the compressor 100, or trim weights 128 could be used on both sides of the compressor 100.

Note that the various forms of the structures shown in FIG. 1 are for illustration only and that other forms for these structures could be used. For example, the extreme outer portion(s) of the projection 116 could be omitted so that the projection 116 only extends from the piston 102 to the magnet 118. As another example, the voice coil 122 could be positioned inward of the magnet 118 instead of outward from the magnet 118. As still another example, each trim weight 128 could be designed to fit within a recess of the associated piston. Also note that different numbers and arrangements of various components in FIG. 1 could be used. For instance, a single magnet 118 could be used, or the spring or flexure bearings 110 could be placed in a different arrangement or changed in number. In addition, the relative sizes and dimensions of the components with respect to one another could be varied as needed or desired.

Figure 2:
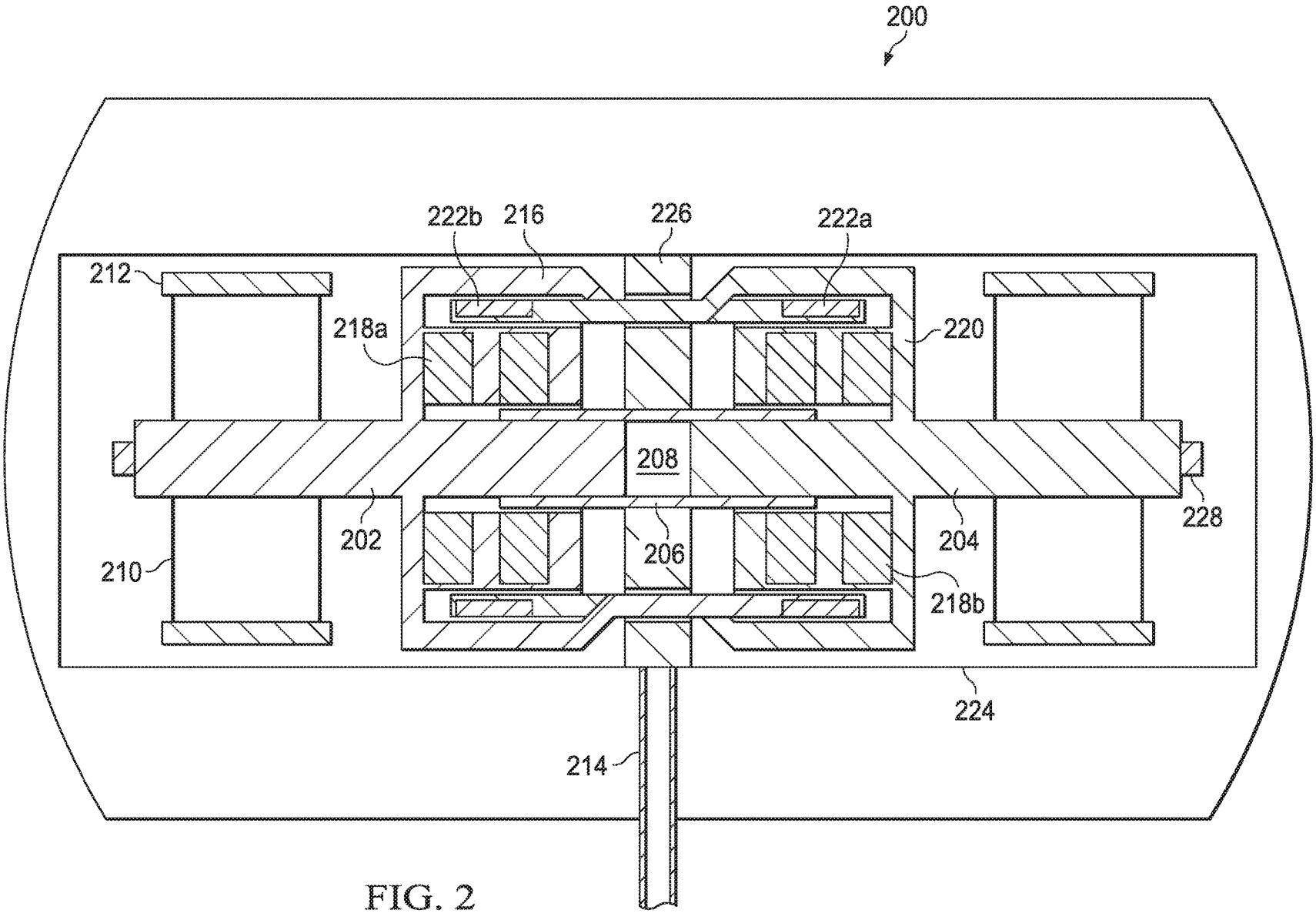
FIG. 2 illustrates a second example push-pull compressor having ultra-high efficiency for cryocoolers or other systems according to this disclosure.

FIG. 2 illustrates a second example push-pull compressor 200 having ultra-high efficiency for cryocoolers or other systems according to this disclosure. As shown in FIG. 2, the compressor 200 includes pistons 202 and 204, a cylinder 206 including a space 208 for fluid, spring or flexure bearings 210, one or more support structures 212, and at least one transfer line 214. The compressor 200 also includes a housing 224, one or more mounts 226, and optionally one or more trim weights 228. These components could be the same as or similar to corresponding components in the compressor 100 of FIG. 1.

Unlike the compressor 100 in FIG. 1, the compressor 200 in FIG. 2 includes multiple voice coil actuators having magnets and voice coils coupled to different pistons. In particular, a first voice coil actuator includes one or more magnets 218*a* that are embedded within, mounted on, or otherwise coupled to one or more projections 216 attached to the piston 202. The first voice coil actuator also includes one or more voice coils 222*b* that are embedded within, mounted on, or otherwise coupled to one or more projections 220 attached to the piston 204. Similarly, a second voice coil actuator includes one or more magnets 218*b* that are embedded within, mounted on, or otherwise coupled to the projection(s) 220. The second voice coil actuator also includes one or more voice coils 222*a* that are embedded within, mounted on, or otherwise coupled to the projection(s) 216.

By energizing the voice coil 222*a* appropriately, the electromagnetic field created by the voice coil 222*a* repeatedly attracts and repels the magnet 218*b*. Similarly, by energizing the voice coil 222*b* appropriately, the electromagnetic field created by the voice coil 222*b* repeatedly attracts and repels the magnet 218*a*. This causes the pistons 202 and 204 to repeatedly move towards each other and move away from each other during multiple compression cycles.

In this arrangement, the multiple voice coil actuators push and pull the pistons 202 and 204 against each other, instead of having multiple voice coil actuators separately push and pull one of the pistons against a fixed structure. Because of this, the voice coil actuators are applying essentially equal and opposite forces against the pistons 202 and 204. As noted above, this can significantly increase the efficiency of the compressor 200 and help to passively reduce or eliminate exported forces from the compressor 200. Moreover, this design maintains symmetry, and both actuators could be driven by a single amplifier. In addition, there is little or no need for the two actuators' efficiencies to be matched to eliminate exported forces.

Note that the various forms of the structures shown in FIG. 2 are for illustration only and that other forms for these structures could be used. For example, the extreme outer portions of the projections 216 and 220 could be straight. As another example, the voice coils 222*a* and 222*b* could be positioned inward of the magnets 218*a* and 218*b* instead of outward from the magnets 218*a* and 218*b*. As still another example, each trim weight 228 could be designed to fit within a recess of the associated piston. Also note that different numbers and arrangements of various components in FIG. 2 could be used. For instance, a single magnet 218 could be used in each projection, or the spring or flexure bearings 210 could be placed in a different arrangement or changed in number. In addition, the relative sizes and dimensions of the components with respect to one another could be varied as needed or desired.

Figure 3:
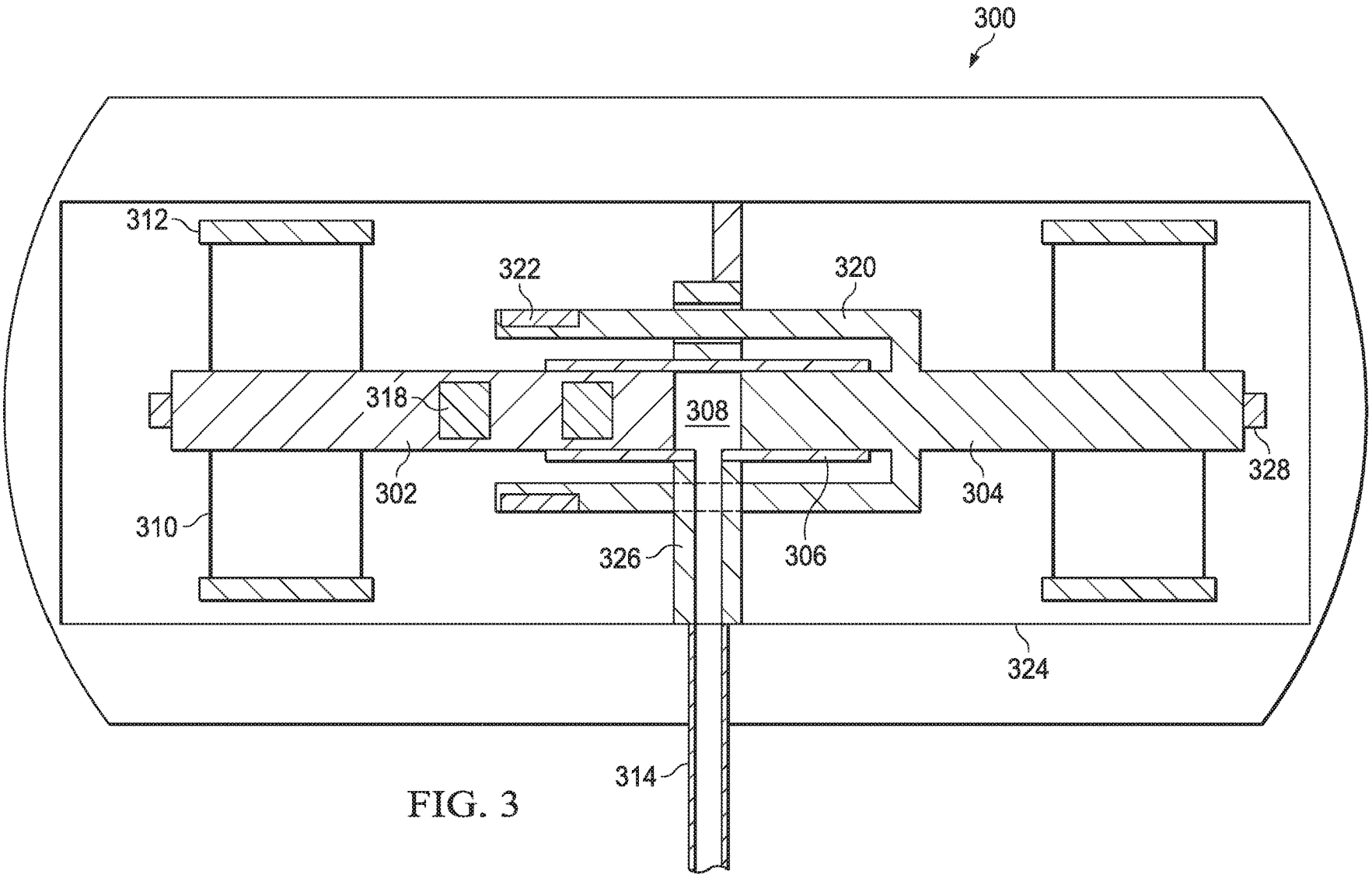
FIG. 3 illustrates a third example push-pull compressor having ultra-high efficiency for cryocoolers or other systems according to this disclosure.

FIG. 3 illustrates a third example push-pull compressor 300 having ultra-high efficiency for cryocoolers or other systems according to this disclosure. As shown in FIG. 3, the compressor 300 includes pistons 302 and 304, a cylinder 306 including a space 308 for fluid, spring or flexure bearings 310, one or more support structures 312, and at least one transfer line 314. The compressor 300 also includes a housing 324, one or more mounts 326, and optionally one or more trim weights 328. These components could be the same as or similar to corresponding components in the compressors 100 and 200 of FIGS. 1 and 2.

A voice coil actuator in FIG. 3 includes one or more magnets 318 and one or more voice coils 322. In this example, however, the one or more magnets 318 are embedded within, mounted on, or otherwise coupled to the piston 302 itself, rather than to a projection extending from the piston 302. The one or more voice coils 322 are embedded within, mounted on, or otherwise coupled to one or more projections 320 attached to the piston 304.

By energizing the voice coil 322 appropriately, the electromagnetic field created by the voice coil 322 repeatedly attracts and repels the magnet 318. This causes the pistons 302 and 304 to repeatedly move towards each other and move away from each other during multiple compression cycles.

In this arrangement, the voice coil actuator pushes and pulls the pistons 302 and 304 against each other, instead of against a fixed structure. Because of this, the voice coil actuator is applying essentially equal and opposite forces against the pistons 302 and 304. As noted above, this can significantly increase the efficiency of the compressor 300 and help to passively reduce or eliminate exported forces from the compressor 300.

Note that the various forms of the structures shown in FIG. 3 are for illustration only and that other forms for these structures could be used. For example, the voice coil 322 could be positioned inward of the magnet 318 instead of outward from the magnet 318. As another example, each trim weight 328 could be designed to fit within a recess of the associated piston. Also note that different numbers and arrangements of various components in FIG. 3 could be used. For instance, a single magnet 318 could be used in the piston 302, or the spring or flexure bearings 310 could be placed in a different arrangement or changed in number. In addition, the relative sizes and dimensions of the components with respect to one another could be varied as needed or desired.

Figure 4:
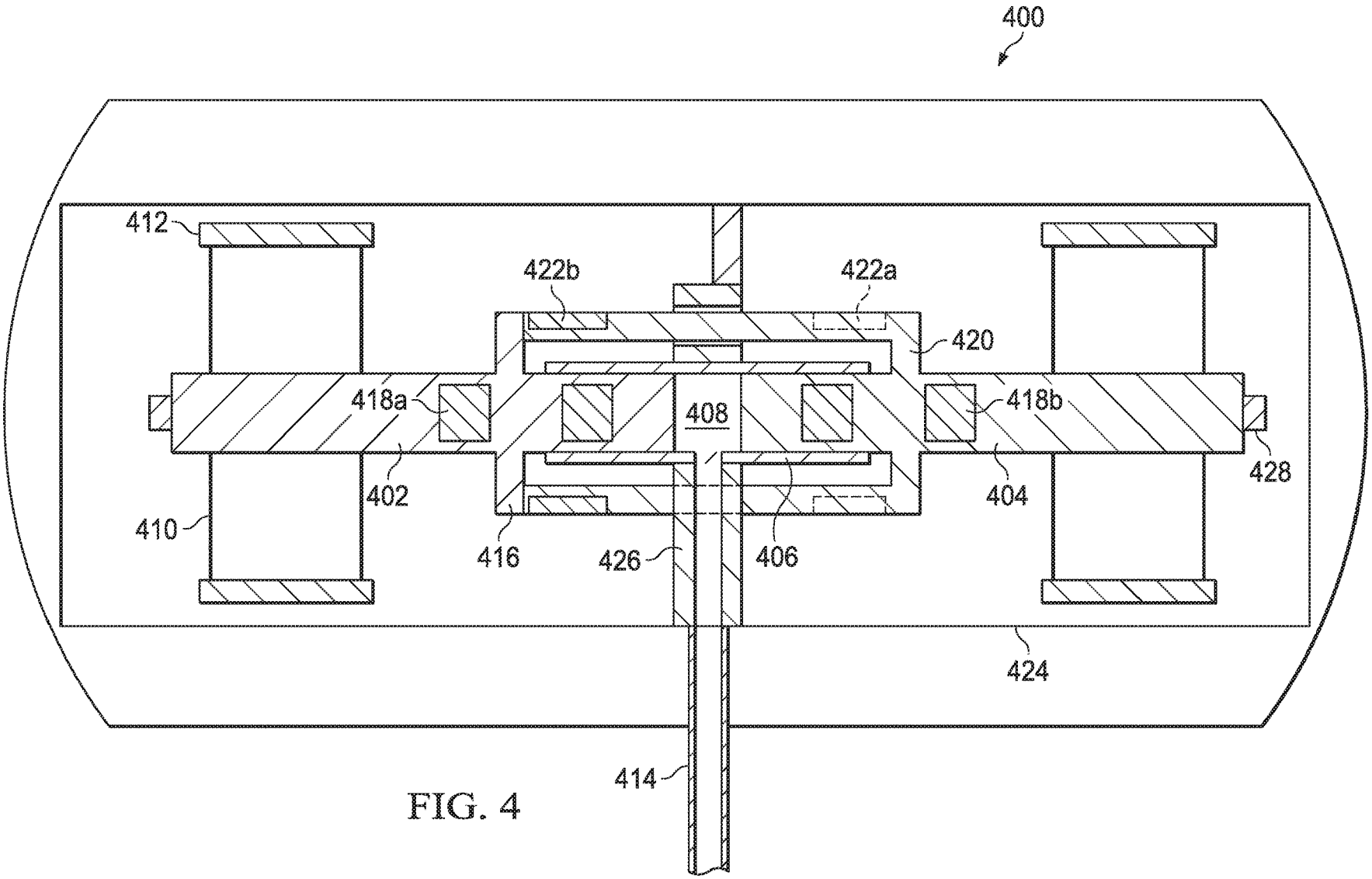
FIG. 4 illustrates a fourth example push-pull compressor having ultra-high efficiency for cryocoolers or other systems according to this disclosure.

FIG. 4 illustrates a fourth example push-pull compressor 400 having ultra-high efficiency for cryocoolers or other systems according to this disclosure. As shown in FIG. 4, the compressor 400 includes pistons 402 and 404, a cylinder 406 including a space 408 for fluid, spring or flexure bearings 410, one or more support structures 412, and at least one transfer line 414. The compressor 400 also includes a housing 424, one or more mounts 426, and optionally one or more trim weights 428. These components could be the same as or similar to corresponding components in any of the compressors described above.

Unlike the compressor 300 in FIG. 3, the compressor 400 in FIG. 4 includes multiple voice coil actuators having magnets and voice coils embedded within, mounted on, or otherwise coupled to different pistons. In particular, a first voice coil actuator includes one or more magnets 418*a* that are embedded within, mounted on, or otherwise coupled to the piston 402. The first voice coil actuator also includes one or more voice coils 422*b* that are embedded within, mounted on, or otherwise coupled to one or more projections 420 attached to the piston 404. Similarly, a second voice coil actuator includes one or more magnets 418*b* that are embedded within, mounted on, or otherwise coupled to the piston 404. The second voice coil actuator also includes one or more voice coils 422*a* that are embedded within, mounted on, or otherwise coupled to one or more projections 416 attached to the piston 402.

By energizing the voice coil 422*a* appropriately, the electromagnetic field created by the voice coil 422*a* repeatedly attracts and repels the magnet 418*b*. Similarly, by energizing the voice coil 422*b* appropriately, the electromagnetic field created by the voice coil 422*b* repeatedly attracts and repels the magnet 418*a*. This causes the pistons 402 and 404 to repeatedly move towards each other and move away from each other during multiple compression cycles.

In this arrangement, the multiple voice coil actuators push and pull the pistons 402 and 404 against each other, instead of having multiple voice coil actuators separately push and pull one of the pistons against a fixed structure. Because of this, the voice coil actuators are applying essentially equal and opposite forces against the pistons 402 and 404. As noted above, this can significantly increase the efficiency of the compressor 400 and help to passively reduce or eliminate exported forces from the compressor 400. Moreover, this design maintains symmetry, and both actuators could be driven by a single amplifier. In addition, there is little or no need for the two actuators' efficiencies to be matched to eliminate exported forces.

Note that the various forms of the structures shown in FIG. 4 are for illustration only and that other forms for these structures could be used. For example, the voice coils 422*a* and 422*b* could be positioned inward of the magnets 418*a* and 418*b* instead of outward from the magnets 418*a* and 418*b*. As another example, each trim weight 428 could be designed to fit within a recess of the associated piston. Also note that different numbers and arrangements of various components in FIG. 4 could be used. For instance, a single magnet 418 could be used in each piston, or the spring or flexure bearings 410 could be placed in a different arrangement or changed in number. In addition, the relative sizes and dimensions of the components with respect to one another could be varied as needed or desired.

Although FIGS. 1 through 4 illustrate examples of push-pull compressors having ultra-high efficiency for cryocoolers or other systems, various changes may be made to FIGS. 1 through 4. For example, the various approaches shown in FIGS. 1 through 4 could be combined in various ways, such as when a voice coil actuator includes magnets embedded within, mounted on, or otherwise coupled to both a projection from a piston and the piston itself. Also, it may be possible depending on the implementation to reverse the magnets and voice coils. For instance, one or more voice coils could be embedded within, mounted on, or otherwise coupled to the pistons themselves and used with magnets embedded within, mounted on, or otherwise coupled to projections from the pistons. In general, there are a wide variety of designs for compressors in which voice coils and magnets can be used so that voice coil actuators cause pistons to push and pull against each other.

Figure 5:
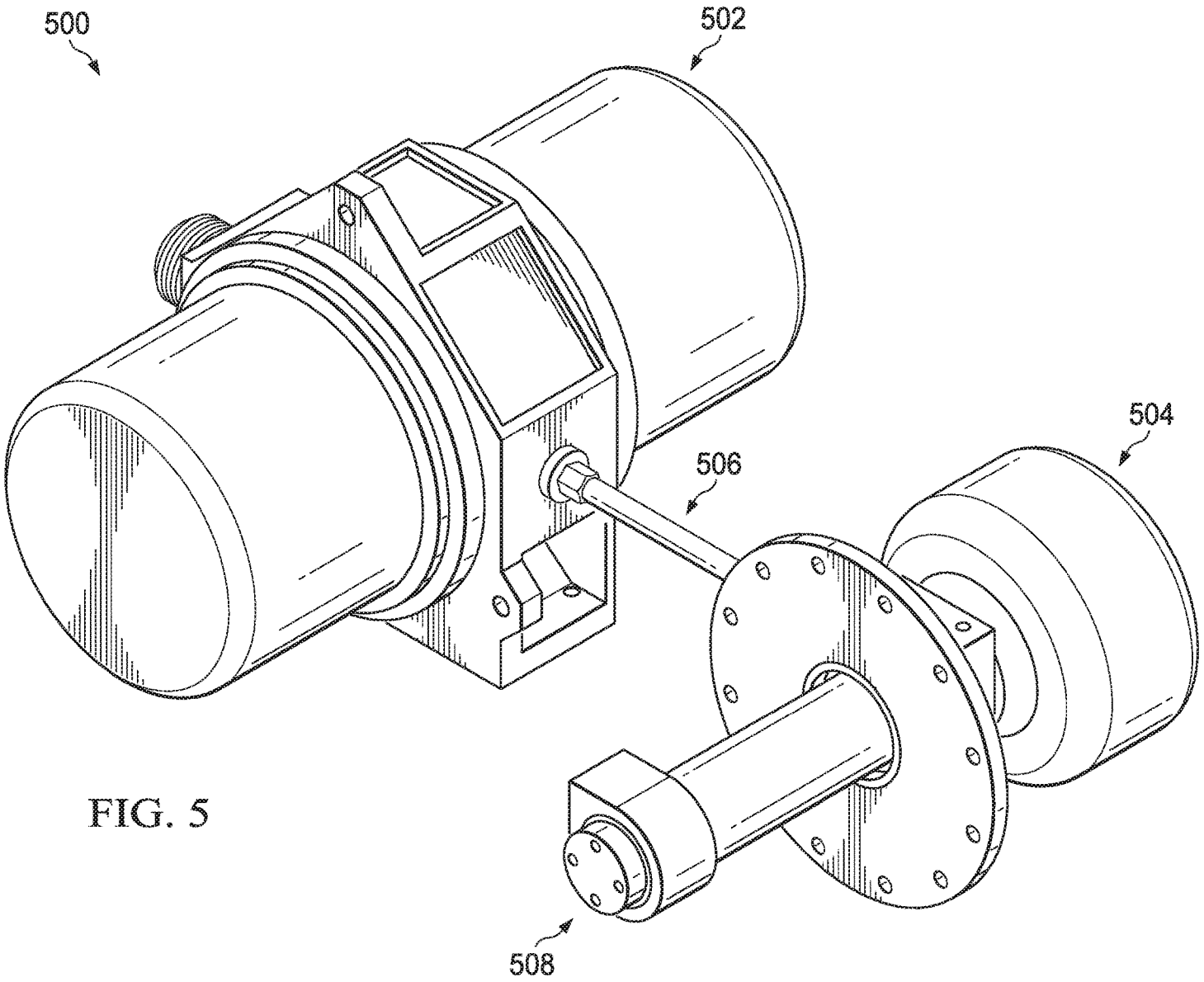
FIG. 5 illustrates an example cryocooler having a push-pull compressor with ultra-high efficiency according to this disclosure.

FIG. 5 illustrates an example cryocooler 500 having a push-pull compressor with ultra-high efficiency according to this disclosure. As shown in FIG. 5, the cryocooler 500 includes a dual-piston compressor 502 and a pulse tube expander 504. The dual-piston compressor 502 could represent any of the compressors 100, 200, 300, 400 described above. The dual-piston compressor 502 could also represent any other suitable compressor having multiple pistons and one or more voice coil actuators used to cause the pistons to push and pull against each other.

The pulse tube expander 504 receives compressed fluid from the compressor 502 via one or more transfer lines 506. The pulse tube expander 504 allows the compressed fluid to expand and provide cooling at a cold tip 508 of the pulse tube expander 504. In particular, the cold tip 508 is in fluid communication with the compressor 502. As the pistons in the compressor 502 move back and forth, fluid is alternately pushed into the cold tip 508 (increasing the pressure within the cold tip 508) and allowed to exit the cold tip 508 (decreasing the pressure within the cold tip 508). This back and forth motion of the fluid, along with controlled expansion and contraction of the fluid as a result of the changing pressure, creates cooling in the cold tip 508. The cold tip 508 can therefore be thermally coupled to a device or system to be cooled. A specific type of cryocooler implemented in this manner is described in U.S. Pat. No. 9,551,513 (which is hereby incorporated by reference in its entirety).

Although FIG. 5 illustrates one example of a cryocooler 500 having a push-pull compressor with ultra-high efficiency, various changes may be made to FIG. 5. For example, cryocoolers using a push-pull compressor could be implemented in various other ways. Also, the compressors described in this patent document could be used for other purposes.

Figure 6:
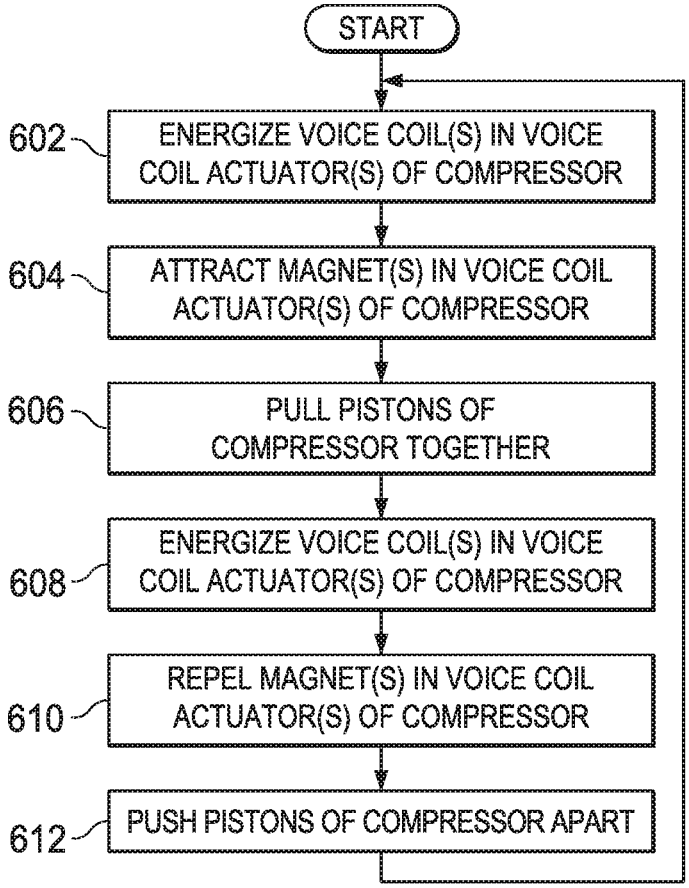
FIG. 6 illustrates an example method for operating a push-pull compressor having ultra-high efficiency for cryocoolers or other systems according to this disclosure.

FIG. 6 illustrates an example method 600 for operating a push-pull compressor having ultra-high efficiency for cryocoolers or other systems according to this disclosure. For ease of explanation, the method 600 is described with respect to the compressors 100, 200, 300, 400 shown in FIGS. 1 through 4. However, the method 600 could be used with any suitable compressor having multiple pistons and one or more voice coil actuators that cause the pistons to push and pull against each other.

As shown in FIG. 6, one or more voice coils of one or more voice coil actuators of a compressor are energized at step 602. This could include, for example, an amplifier providing one or more electrical signals to one or more of the voice coils 122, 222*a*-222*b*, 322, 422*a*-422*b*. The one or more electrical signals cause the voice coil(s) to generate one or more electromagnetic fields. This attracts one or more magnets of the voice coil actuator(s) at step 604, which pulls pistons of the compressor together at step 606. This could include, for example, the electromagnetic field(s) generated by the voice coil(s) magnetically attracting one or more magnets 118, 218*a*-218*b*, 318, 418*a*-418*b*. Because the voice coil(s) and the magnet(s) are connected to different pistons 102-104, 202-204, 302-304, 402-404 (either directly or indirectly via a projection), the magnetic attraction causes both pistons to move inward towards each other.

The one or more voice coils of the one or more voice coil actuators of the compressor are again energized at step 608. This could include, for example, the amplifier providing one or more additional electrical signals to the one or more voice coils 122, 222*a*-222*b*, 322, 422*a*-422*b*. The one or more additional electrical signals cause the voice coil(s) to generate one or more additional electromagnetic fields. This repels the magnet(s) of the voice coil actuator(s) at step 610, which pushes the pistons of the compressor apart at step 612. This could include, for example, the electromagnetic field(s) generated by the voice coil(s) magnetically repelling the magnet(s) 118, 218*a*-218*b*, 318, 418*a*-418*b*. Because the voice coil(s) and the magnet(s) are connected to different pistons 102-104, 202-204, 302-304, 402-404 (either directly or indirectly via a projection), the magnetic repelling causes both pistons to move outward away from each other.

By repeating the method 600 multiple times, multiple compression cycles can occur, each involving one movement of the compressor pistons inward and one movement of the compressor pistons outward. The number of compression cycles in a given time period can be controlled, such as by controlling the driving of the voice coil actuators. As described in detail above, because each voice coil actuator has a magnet that moves with one piston and a voice coil that moves with another piston, the efficiency of the compressor can be significantly increased, and the exported forces from the compressor can be significantly decreased.

Although FIG. 6 illustrates one example of a method 600 for operating a push-pull compressor having ultra-high efficiency for cryocoolers or other systems, various changes may be made to FIG. 6. For example, while shown as a series of steps, various steps in FIG. 6 could overlap, occur in parallel, occur in a different order, or occur any number of times. As a particular example, steps 602-606 could generally overlap with one another, and steps 608-612 could generally overlap with one another.

In some embodiments, various functions described in this patent document are implemented or supported by a computer program that is formed from computer readable program code and that is embodied in a computer readable medium. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

It may be advantageous to set forth definitions of certain words and phrases used throughout this patent document. The terms "application" and "program" refer to one or more computer programs, software components, sets of instructions, procedures, functions, objects, classes, instances, related data, or a portion thereof adapted for implementation in a suitable computer code (including source code, object code, or executable code). The term "communicate," as well as derivatives thereof, encompasses both direct and indirect communication. The terms "include" and "comprise," as well as derivatives thereof, mean inclusion without limitation. The term "or" is inclusive, meaning and/or. The phrase "associated with," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

The description in the present application should not be read as implying that any particular element, step, or function is an essential or critical element that must be included in the claim scope. The scope of patented subject matter is defined only by the allowed claims. Moreover, none of the claims invokes 35 U.S.C. § 112(f) with respect to any of the appended claims or claim elements unless the exact words "means for" or "step for" are explicitly used in the particular claim, followed by a participle phrase identifying a function. Use of terms such as (but not limited to) "mechanism," "module," "device," "unit," "component," "element," "member," "apparatus," "machine," "system," "processor," or "controller" within a claim is understood and intended to refer to structures known to those skilled in the relevant art, as further modified or enhanced by the features of the claims themselves, and is not intended to invoke 35 U.S.C. § 112(f).

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. An apparatus comprising:

a first piston and an opposing second piston, the first and second pistons configured to move inward to narrow a space therebetween and to move outward to enlarge the space therebetween; and a first voice coil actuator comprising (i) a first voice coil connected to the first piston and (ii) a first magnet connected to the second piston.

2. The apparatus of claim 1, wherein the first voice coil is configured to generate a varying electromagnetic field that repeatedly attracts and repels the first magnet.

3. The apparatus of claim 1, wherein the first voice coil actuator is configured to apply equal and opposite forces on or against the first and second pistons.

4. The apparatus of claim 1, further comprising:

a second voice coil actuator comprising (i) a second voice coil connected to the second piston and (ii) a second magnet connected to the first piston.

5. The apparatus of claim 4, wherein the second voice coil is configured to generate a varying electromagnetic field that repeatedly attracts and repels the second magnet.

6. The apparatus of claim 4, wherein the second voice coil actuator is configured to apply equal and opposite forces on or against the first and second pistons.

7. The apparatus of claim 1, further comprising:

at least one trim weight coupled to one or more of the first and second pistons, each trim weight configured to change a resonance of a total mass of one side of the apparatus.

8. The apparatus of claim 1, further comprising:

at least one first spring or flexure bearing configured to support and allow linear movement of the first piston; and at least one second spring or flexure bearing configured to support and allow linear movement of the second piston.

9. A system comprising:

a compressor configured to compress a fluid, wherein the compressor comprises:

a first piston and an opposing second piston, the first and second pistons configured to move inward to narrow a space therebetween and to move outward to enlarge the space therebetween; and a first voice coil actuator comprising (i) a first voice coil connected to the first piston and (ii) a first magnet connected to the second piston.

10. The system of claim 9, wherein the first voice coil is configured to generate a varying electromagnetic field that repeatedly attracts and repels the first magnet.

11. The system of claim 9, wherein the first voice coil actuator is configured to apply equal and opposite forces on or against the first and second pistons.

12. The system of claim 9, wherein the compressor further comprises:

a second voice coil actuator comprising (i) a second voice coil connected to the second piston and (ii) a second magnet connected to the first piston.

13. The system of claim 12, wherein the second voice coil is configured to generate a varying electromagnetic field that repeatedly attracts and repels the second magnet.

14. The system of claim 12, wherein the second voice coil actuator is configured to apply equal and opposite forces on or against the first and second pistons.

15. The system of claim 9, wherein the compressor further comprises:

at least one trim weight coupled to one or more of the first and second pistons, each trim weight configured to change a resonance of a total mass of one side of the compressor.

16. The system of claim 9, wherein the compressor further comprises:

at least one first spring or flexure bearing configured to support and allow linear movement of the first piston; and at least one second spring or flexure bearing configured to support and allow linear movement of the second piston.

17. The system of claim 9, further comprising:

an expander configured to allow the compressed fluid to expand and generate cooling.

18. A method comprising:

coupling a first voice coil of a first voice coil actuator to a first piston; and coupling a first magnet of the first voice coil actuator to a second piston;

wherein the first voice coil actuator is configured to cause the first and second pistons to move inward to narrow a space therebetween and to move outward to enlarge the space therebetween.

19. The method of claim 18, further comprising:

coupling a second voice coil of a second voice coil actuator to the second piston; and coupling a second magnet of the second voice coil actuator to the first piston;

wherein the first and second voice coil actuators are configured to cause the first and second pistons to move inward to narrow the space therebetween and to move outward to enlarge the space therebetween.

20. The method of claim 18, further comprising:

coupling at least one trim weight to one or more of the first and second pistons, each trim weight changing a resonance of a total mass of one side of an apparatus that includes the first and second pistons.

* * * * *